US011400332B1

(12) United States Patent
Alford et al.

(10) Patent No.: US 11,400,332 B1
(45) Date of Patent: Aug. 2, 2022

(54) RESISTANCE BAND APPARATUS, METHOD, AND SYSTEM

(71) Applicants: Luke Alford, Kernersville, NC (US); Rodney Alford, Kernersville, NC (US); Tony Alford, Kernersville, NC (US)

(72) Inventors: Luke Alford, Kernersville, NC (US); Rodney Alford, Kernersville, NC (US); Tony Alford, Kernersville, NC (US)

( * ) Notice: Subject to any disclaimer, the term of this patent is extended or adjusted under 35 U.S.C. 154(b) by 0 days.

(21) Appl. No.: 17/467,881

(22) Filed: Sep. 7, 2021

Related U.S. Application Data

(60) Provisional application No. 63/201,737, filed on May 11, 2021.

(51) Int. Cl.

| | |
|---|---|
| ***A63B 21/00*** | (2006.01) |
| ***A63B 21/072*** | (2006.01) |
| ***A63B 21/04*** | (2006.01) |
| ***A63B 24/00*** | (2006.01) |

(52) U.S. Cl.
CPC .... *A63B 21/00069* (2013.01); *A63B 21/0414* (2013.01); *A63B 21/072* (2013.01); *A63B 24/0062* (2013.01); *A63B 2220/17* (2013.01); *A63B 2220/54* (2013.01); *A63B 2220/833* (2013.01); *A63B 2225/09* (2013.01)

(58) Field of Classification Search
CPC ..... A63B 21/00043; A63B 21/0407; A63B 21/0414; A63B 21/0435; A63B 21/0442; A63B 21/055; A63B 21/0552; A63B 21/0555; A63B 21/0557
See application file for complete search history.

(56) References Cited

U.S. PATENT DOCUMENTS

| | | | | |
|---|---|---|---|---|
| 4,361,324 | A * | 11/1982 | Baroi | A63B 21/4003 482/108 |
| 7,387,599 | B1 * | 6/2008 | Hsu | A61H 15/0092 482/122 |
| 7,591,763 | B1 * | 9/2009 | Fucci | A63B 21/0552 482/121 |
| 7,618,356 | B1 * | 11/2009 | Johnson | A43B 3/0042 36/136 |
| 7,896,787 | B2 * | 3/2011 | LaSala | A61H 15/0092 482/127 |
| 8,287,434 | B2 | 10/2012 | Zavadsky et al. | |
| 8,986,173 | B1 * | 3/2015 | Adams | A63B 21/0557 482/106 |
| 9,308,417 | B2 | 4/2016 | Grundy | |
| 9,339,678 | B2 * | 5/2016 | Gallagher | A61B 5/024 |
| 9,849,333 | B2 | 12/2017 | Fung | |
| 9,868,015 | B2 * | 1/2018 | Bowles | A63B 21/153 |
| 10,569,124 | B2 | 2/2020 | Dalmia et al. | |
| 10,751,559 | B2 | 8/2020 | Constanza | |

(Continued)

*Primary Examiner* — Joshua Lee
(74) *Attorney, Agent, or Firm* — Dunlap Bennett & Ludwig, PLLC

(57) ABSTRACT

A system for selectively adjusting the fixed length of a single, retractable elastic body. The system enables control of the resistivity of the elastic body as well as a definitive determination of a level of force exerted against the single elastic body. The determined level of force is represented on an interface device embodied in a housing for the elastic body. The data associated with the determined level of force can be wirelessly communicated to other users' interface devices or smart devices for facilitating healthy competition between users.

11 Claims, 4 Drawing Sheets

(56) References Cited

U.S. PATENT DOCUMENTS

| | | | | |
|---|---|---|---|---|
| 10,813,388 | B2 | 10/2020 | Cobbett et al. | |
| 10,857,425 | B2 | 12/2020 | Thomas | |
| 11,073,356 | B2 * | 7/2021 | Pell | A63B 69/00 |
| 2002/0086779 | A1 * | 7/2002 | Wilkinson | A63B 21/00069 482/118 |
| 2002/0160891 | A1 * | 10/2002 | Gallagher | A63B 21/154 482/123 |
| 2005/0124471 | A1 * | 6/2005 | Wilkinson | A63B 21/153 482/121 |
| 2010/0204024 | A1 * | 8/2010 | Mills | A63B 21/015 482/130 |
| 2010/0317488 | A1 | 12/2010 | Cartaya | |
| 2016/0067578 | A1 * | 3/2016 | Matte | A47D 13/086 473/424 |
| 2017/0128765 | A1 | 5/2017 | Garretson et al. | |
| 2017/0312582 | A1 * | 11/2017 | Root, Jr. | A63B 21/4009 |
| 2018/0021629 | A1 | 1/2018 | DeLuca et al. | |
| 2019/0001175 | A1 * | 1/2019 | Wagner | A63B 21/153 |
| 2020/0023229 | A1 | 1/2020 | Oltorik et al. | |
| 2020/0086162 | A1 | 3/2020 | Garcia | |
| 2020/0086163 | A1 | 3/2020 | Karys | |
| 2020/0116453 | A1 * | 4/2020 | Pell | A63B 71/0622 |
| 2020/0206556 | A1 | 7/2020 | Souffrain | |
| 2020/0261758 | A1 | 8/2020 | Souffrain | |
| 2020/0289890 | A1 | 9/2020 | Kim et al. | |

* cited by examiner

RESISTANCE BAND APPARATUS, METHOD, AND SYSTEM

CROSS-REFERENCE TO RELATED APPLICATION

This application claims the benefit of priority of U.S. provisional application No. 63/201,737, filed 11 May 2021, the contents of which are herein incorporated by reference.

BACKGROUND OF THE INVENTION

The present invention relates to the fitness arts and, more particularly, a resistance band apparatus, method, and system embodying a retractable mechanism operatively associated with an elastic body for selectively controlling and sensing an associated performance of a user (e.g., their performance profile) as a function of the force exerted on the elastic body.

Strength training employ elastic material embodied in resistance bands to promote the building of muscles and the burning of fat, while physical therapists use resistance bands to also increase a range of movement and improve a number of metabolic factors.

The resistance of the band as well as number of repetitions are the main variables used to lower or increase the intensity of a workout or performance profile. However, a user cannot easily determine how much force is being exerted against a resistance band. Therefore, accurately quantify the level of force, the intensity or performance profile users are exerting relative to the resistance bands is a significant disadvantage.

This problem is only magnified by the use of a plurality resistance bands, considering that there are many types of resistance bands and many manufactures for each type. In addition to the compounded problem of indeterminacy posed by simultaneously using a plurality of resistance bands, the use of a multiplicity of bands, as a practical matter, has its own practical problem: tangling of the multiple bands. As a result, users may be disincentivized to engage in resistance-band fitness activities, which is unfortunate as such activities are otherwise a very effective way to exercise.

As can be seen, there is a need for an apparatus, method, and system embodying a retractable mechanism operatively associated with a single elastic body for selectively controlling and sensing an associated performance profile of a user thereof, wherein the resistance band apparatus affords a plurality of convenient and user-friendly embodiments, including band grip elements and wireless communication functionalities, coupled with the resistance band apparatus. The method embodies one retractable elastic band selectively increasing or decreasing its fixed lengths in such a way as to provide multiple resistance levels to perform strengthening exercises. The retractable mechanism may have a housing unit (e.g., dumbbell/barbell) to completely roll up the elastic body when not in use. When in use, the present invention may act as a single stationary and immovable resistance band to exercise, wherein the fixed length is selectively adjustable. In other words, a simple compact way to provide selective resistance through a single elastic body, whereby associated functionality to connect remote users is facilitated, thereby further incentivizing users to stay in shape, stay healthy, stay fit, and stay connected.

SUMMARY OF THE INVENTION

In one aspect of the present invention, a system for selectively establishing a fixed length of an elastic body.

In another aspect of the present invention, the system further includes wherein the elastic body is movable between a retracted position and one of a plurality of successively extended positions further protruding from a housing, wherein the housing provides a locking mechanism for selectively engaging each of the extended positions, whereby the fixed length is established.

In yet another aspect of the present invention, the system further includes the following components: a user interface; one or more processors; and a non-transitory computer-readable memory coupled to the one or more processors and the user interface and storing instructions thereon that, when executed by the one or more processors, causing the system to: receive exercise for the elastic body, including information indicative of a level of force exerted against the elastic body; and present one or more force determinations, based on the information indicative of a level of force, on the user interface; further including one or more force sensors operatively associated with the elastic body, wherein the one or more force sensor collects the information indicative of a level of force, wherein the one or more force sensors includes a strain gauge or the one or more force sensors includes a torque sensor; further including a communication module for exporting each force determination, wherein for each force determination, receive exercise data associated with the housing, further including a ratchet portion for coiling and recoiling the elastic body about a spool to which the torque sensor is coupled; and a bar grip perpendicularly extending from a center of the housing, wherein the bar grip is connected to a second housing of the elastic body.

In still yet another aspect of the present invention, a method for communicating between a plurality of users of resistance bands, the method includes providing the above-disclosed system to each user, wherein each force determination and exercise data is shared between the other users by way of the respective user interface and representing the exercise data as a function of time on the user interface, wherein the exercise data as a function of time includes a count of the repetitions of each force determination.

These and other features, aspects and advantages of the present invention will become better understood with reference to the following drawings, description and claims.

DETAILED DESCRIPTION OF THE INVENTION

Figure 1:
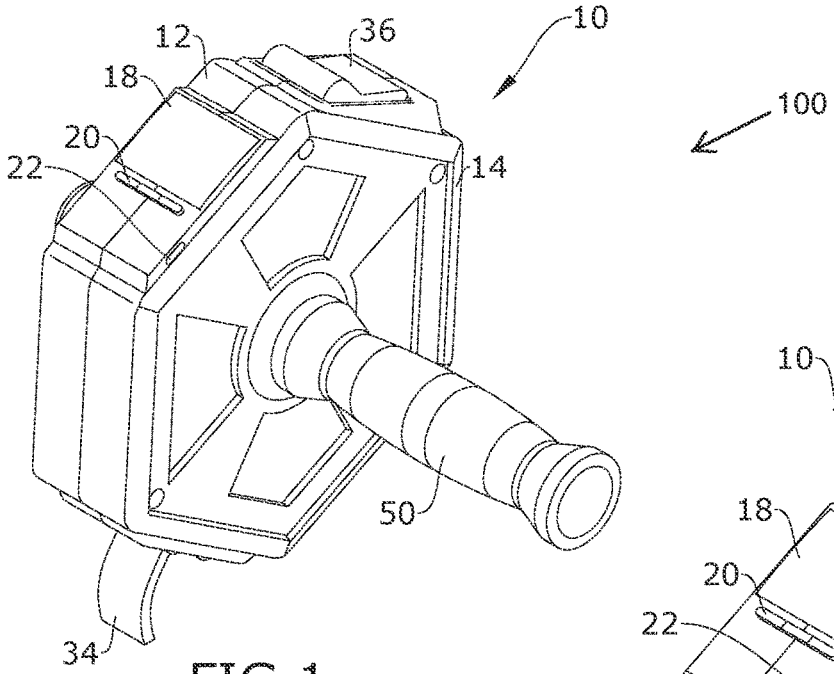
FIG. 1 is a perspective view of an exemplary embodiment of the present invention.
Figure 2:
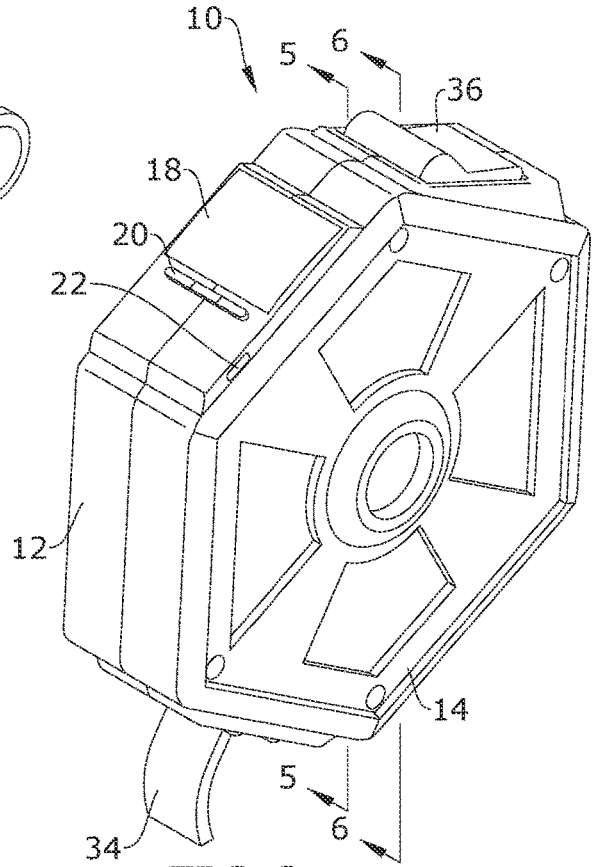
FIG. 2 is a perspective view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Referring now to FIGS. 1 through 8, the present invention may include a resistance band system 100. The resistance band system 100 embodies a method of employing at least one elastic body 34 embodied in a resistance band apparatus 10, wherein certain embodiments, there may be two or more elastic bodies 34 or bands employed by the resistance band apparatus 10.

The elastic body 34 may comprise any material that when deformed due to an external force, experiences internal resistance to the deformation and restores it to its original state if the external force is no longer applied, including rubber (natural or synthetic), silicone, various plasticized materials and the like. This elastic property is represented in a linear relationship commonly referred to as Hooke's law ($F=k*x$). This law can be stated as a relationship between tensile force F and corresponding extension displacement x, wherein k is a constant known as the rate or spring constant. It can also be stated as a relationship between stress and strain, the elastic modulus or Young's modulus, E, which is the ratio of stress over strain. As a result, by changing unfixed length of a body of elastic material influences the stress-related properties which in turn influences the requisite tensile force (F) needed for a predetermined displacement (x).

It should be understood that the resistance band apparatus 10 may be any object, and that the elastic body 34 may be any material and any shape/cross-sectional area that enables the functionality disclosed herein. Furthermore, the embodiments disclosed herein and in the appended Figures are illustrative but not exhaustive of the inventive concept.

The resistance band apparatus 10 may include an enclosure defined by a housing. The housing, in certain embodiments, may comprise a first housing portion 12 and a second housing portion 14 that are movable between an open condition for maintenance and repair and an enclosed condition for operation. The enclosed condition may be secured by way of fasteners 48 and 16.

Figure 5:
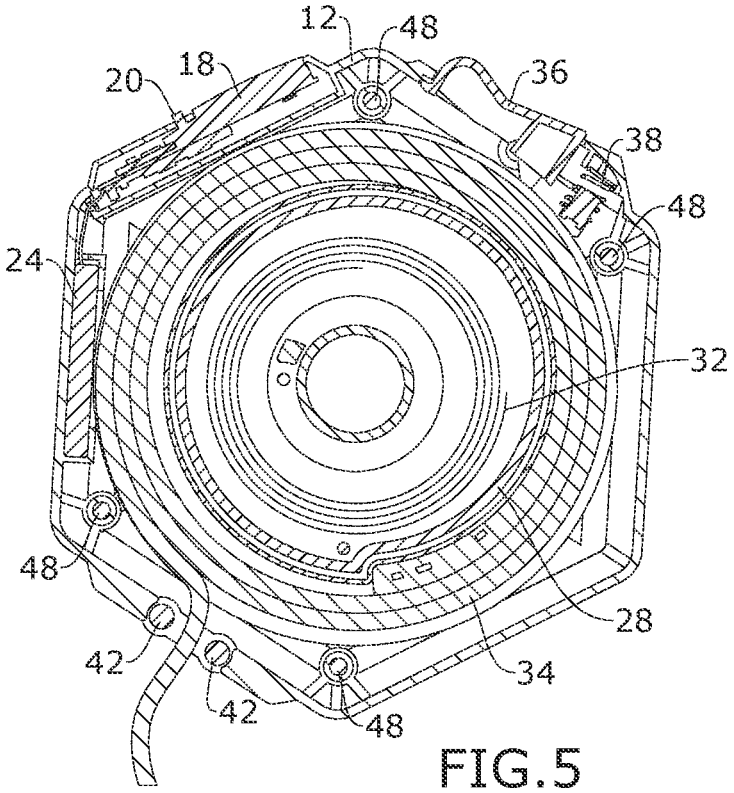
FIG. 5 is a section view of an exemplary embodiment of the present invention, taken along line 5-5 in FIG. 2.
Figure 6:
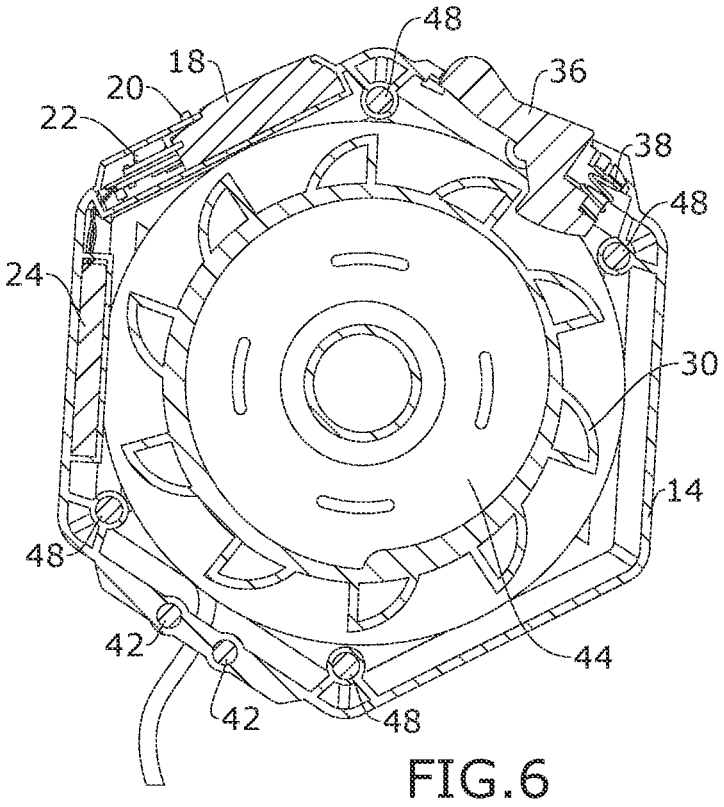
FIG. 6 is a section view of an exemplary embodiment of the present invention, taken along line 6-6 in FIG. 2.

The enclosure may house a ratchet mechanism having first ratchet portion 28 and a second ratchet portion 30 that operatively associate with a recoil spring 32, recoil spring index pins 40 and a spool 59 to rotatably extend and retract the elastic body 34 about the spool 59. The second ratchet portion 30 may provide ratchet teeth 39 to controllably engage a spring 38 biasing a locking switch 36 for selectively locking a desired extended/retracted fixed length of the elastic body 34, as illustrated in FIGS. 5 and 6.

Figure 7:
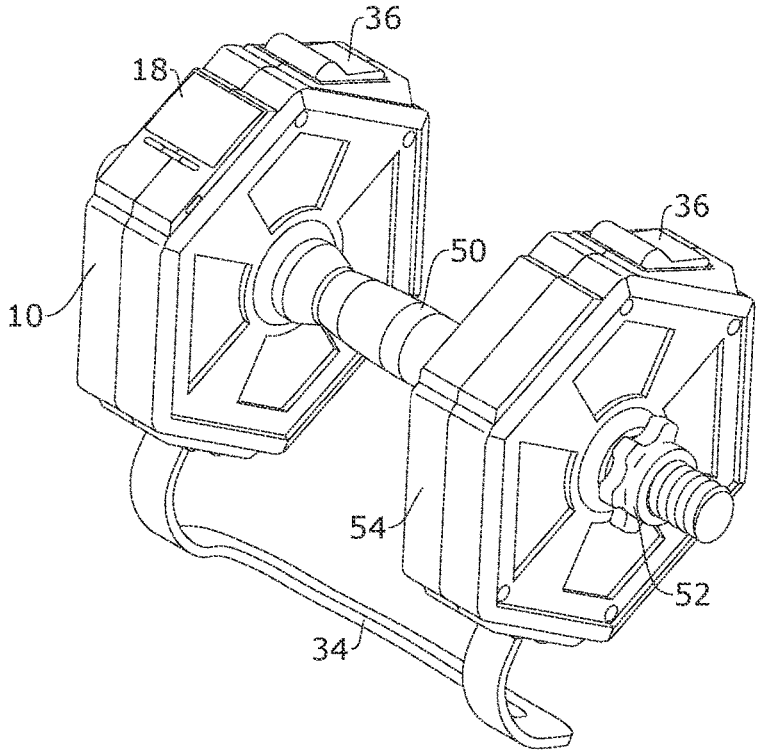
FIG. 7 is a perspective view of an exemplary embodiment of the present invention.
Figure 8:
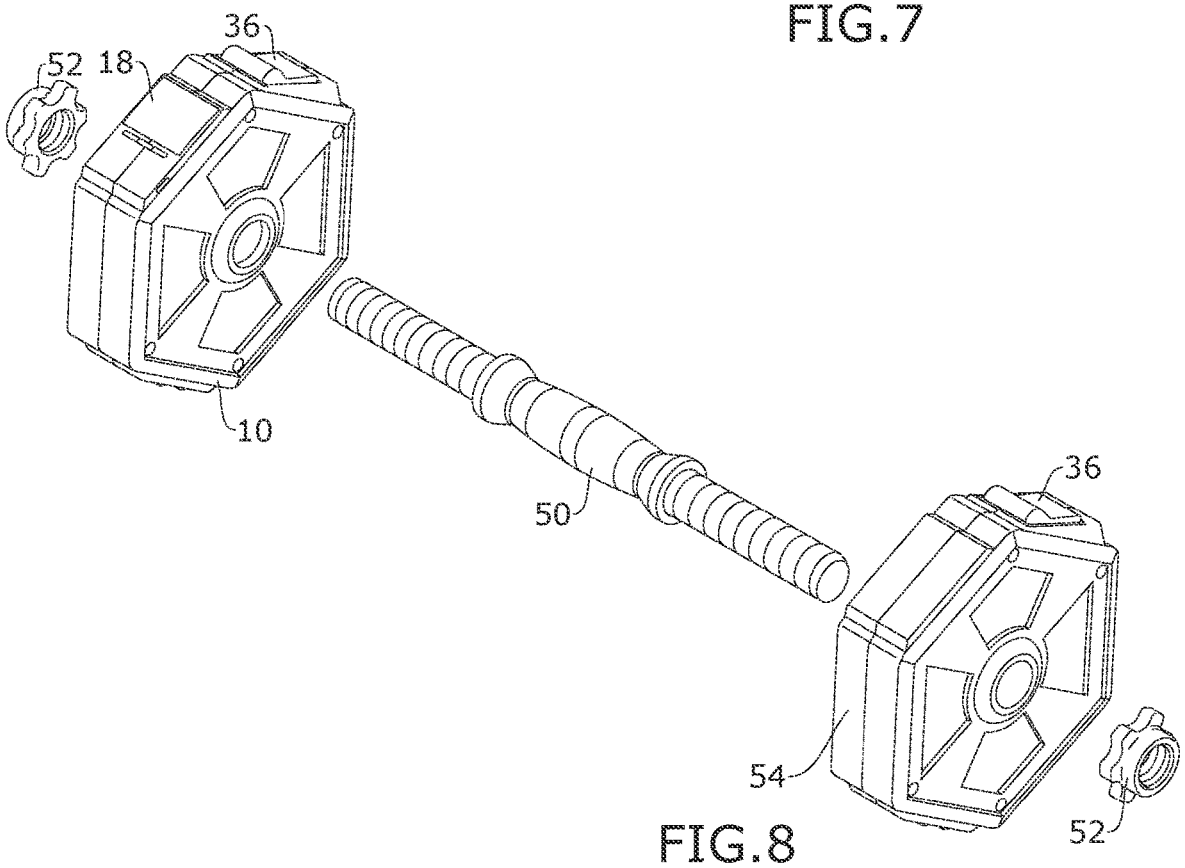
FIG. 8 is an exploded perspective view of an exemplary embodiment of the present invention.

The ratchet mechanism may include a ratchet lid 44. The ratchet mechanism may also include rollers 42 at an opening of the housing through which the elastic body 34 may uncoil and recoil through, and a band bracket 46 to further facilitate the extensibility and retractability of the elastic body 34. Alternatively, a motorized retractable (resistance band or elastic rubber on a circular) tube like device may be employed, The resistance band apparatus 10 may also include external components such as a bar grip element 50, that itself is conveniently portable and storable. The grip element 50 may be dimensioned and adapted for operatively coupling to a second resistance band apparatuses 10 or a resistive band component 54, as illustrated in FIGS. 7 and 8. The bar grip element 50 may be locked in place by a bar lock 52.

In certain embodiments, the resistance band apparatus 10 may embody a dumbbell/barbell enabling the elastic body 34, for instance resistance latex bands, to retract back into the enclosure, thereby housing the elastic body 34. The multiple lengths and resistance are determined by how much elastic body 34 is rolled off the spool 59 and fixed by the locking element of the locking switch 36. The elastic body 34 can go fully back into housing with, in certain embodiments, the button activating/deactivating the locking switch is on the head of the dumbbell/barbell. When a user wants to exercise, he/she may selectively pull out as much elastic body 34 as necessary to get resistance for the exercise routine desired to be performed. Once the desired length user has determined the elastic body 34 may be selectively locked into place, allowing the user to use whatever force necessary to get the resistance to perform the exercises at maximum force to achieve muscle atrophy.

A method of manufacturing the present invention may include the following: injection molded or additive manufactured housing of including but not limited to a shaft; a spool; heavy duty retractable spring for recoil; gears with saw teeth design to extend the band out of the housing; and a brake system which will lock the band into an immovable state. Various plasticized materials, various metallic materials, and synthetic foam material may be used to will achieve the desired end products.

A method of using the present invention may include the following. The system 100 disclosed above may be provided. Either at home, office, hotel, travel, indoor or outside a user may take the portable system of the resistance band apparatus 10 and use it to get a complete full body workout while utilizing minimum equipment and space to achieve the total body exercise regime. For instance, a user may simply anchor the elastic body 34 to a foot, door anchor and/or some structure of stability and selectively pull out the length of elastic body 34 necessary for the exercise intended. When extended and locked into place the elastic body 34, the present invention enables resistance and force that mimics traditional weights for the force needed to selectively workout a desired muscle. When the workout is complete the user can, in certain embodiments, push the button on the housing of the dumbbell/barbell to engage the high-tension spring and release the break of the ratchet portions and the elastic body 34 will roll itself back into the housing until the entire elastic body 34 is now inside the unit/head/housing. Thereby, making a user's workout experience uncluttered and saving space and making it easy to carry between locations.

The present invention can replace other workout equipment. Furthermore, the present invention can be used for medical physical healing therapy as the present invention enables keeping track of the user's exercising data, such as calories burned, and keep the user motivated to maintain their exercise regime.

The resistance band system 100 may also include wireless communication functionality, for instance Bluetooth® technology, thereby enabling one or more users to connect virtually to a software application and/or each other. This wireless technology feature may communicate with the user's mobile smart devices 56 through a software application, connecting the output of the resistance band apparatus 10 or any systemic retracting elastic body mechanism, and thereby keeping track of exercise data, such as but not limited to weight, and repetitions, calories, heart rate, etc. The wireless communication functionality enables the user to have competition among friends and family. The present invention may also help with remote rehabilitation and live training, and therapy between doctor and patients. This wireless communication functionality may also connect a user via their smart device for a virtual reality or augmented reality experience with your workout partner.

Specifically, the enclosure may accommodate one or more performance modules 60 operatively associated with an interface device 18, which may include a user interface having touchscreen functionality. The interface device 18 may be interfaceable along or beyond an exterior surface of the housing/apparatus 10. The interface device 18 may include control buttons 20.

It is understood that any number of performance modules 60 may be used in the system 100. It is further contemplated that performance module 60 may include multiple modules (such as, but not limited to, a power module, an electronic module, sensor module, and a wireless communication module) working in conjunction with one another, and that the various modules may be substantially different from one another. The performance modules 60 and interface device 18 comprise the portions of the system 100 that a user interacts with. Accordingly, the performance module 60 and the interface device 18 has a power source 24 electrically connected (via connectors 26) thereto.

Figure 3:
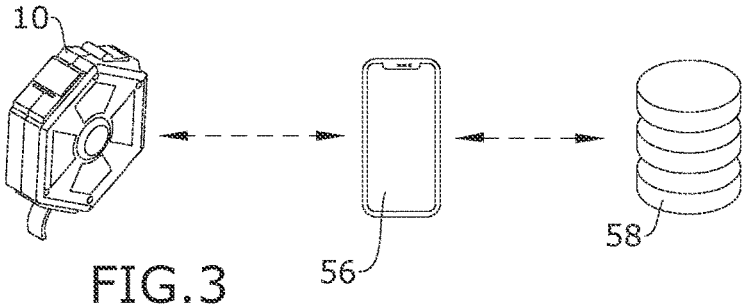
FIG. 3 is a schematic view of an exemplary embodiment of the present invention.
Figure 4:
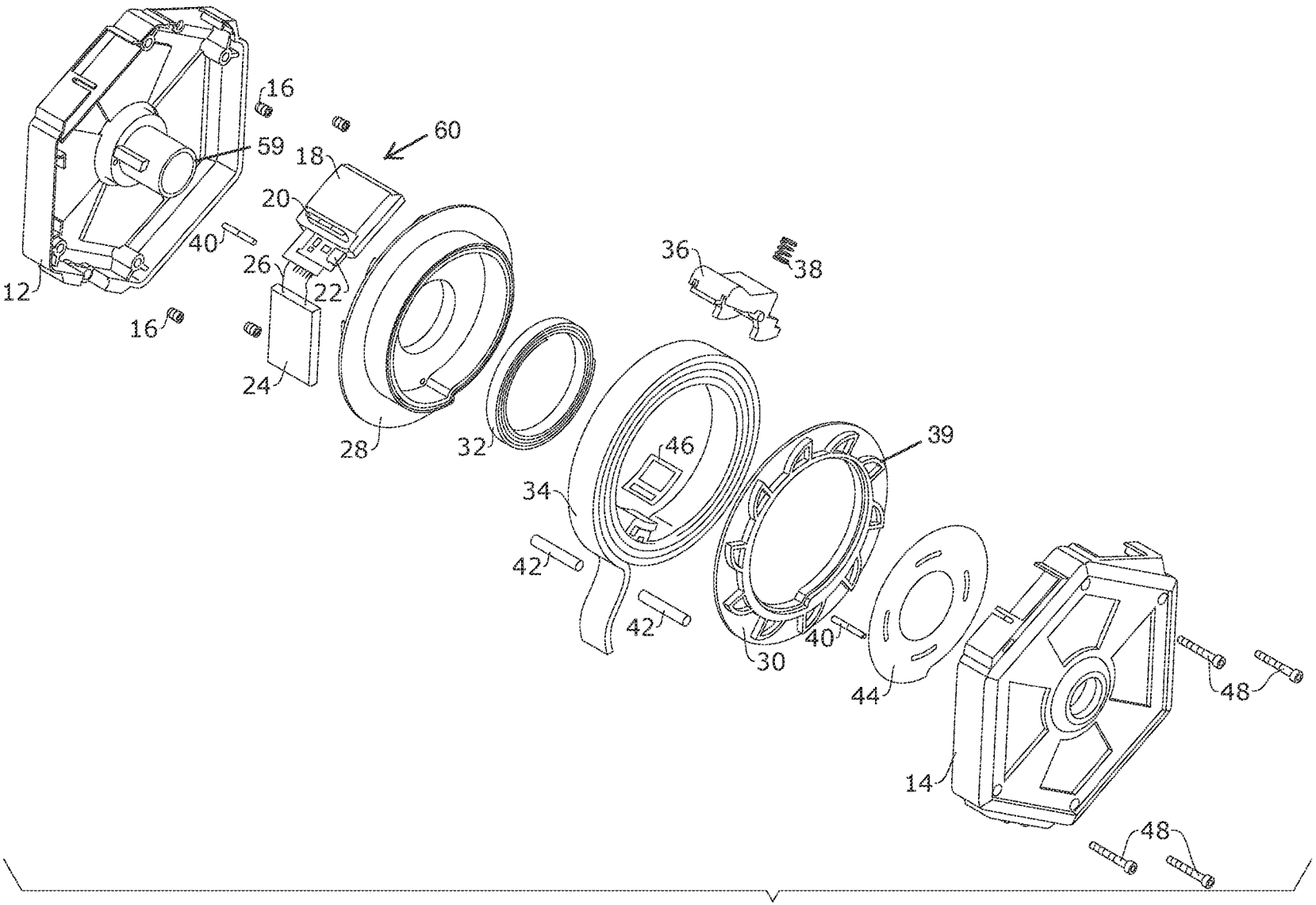
FIG. 4 is an exploded perspective view of an exemplary embodiment of the present invention.

Each performance module 60 has a control circuitry coupling one or more processors coupled to one or more non-transitory computer readable storage devices that may perform any of the actions described herein, storing collected data, and transmitting the collected data to interface device 18, and/or server system 58 via an electronic network, as illustrated in FIG. 3. The server system 58 may be coupled to a terminal 56, such as a user smart device, as well as a database for retrievable storing software applications including but not limited to virtual reality program products mentioned herein.

The control circuitry may be coupled to the wireless communication module having an antenna or other suitable signal propagation devices configured to assist the wireless communication module in data transmission and/or amplification. The wireless communication module may be configured to transmit data from the control circuitry to, e.g., the interface device 18, or otherwise over a network. Wireless communication module may be configured to transmit information over one or more wireless modalities, such as, e.g., Bluetooth, Bluetooth low energy (BLE), infrared, cellular networks, and wireless networks, among others. A wired port 22, such as, e.g., a USB or other suitable port may couple performance module 60 to a third-party device 56 to transmit and receive data in addition or alternative to the discussed wireless mechanisms. Thus, performance module 60 may include one or more forms of network connectivity for storage and sharing of collected data.

The performance module 60 may include a sensor module coupled to a plurality of sensors and the control circuitry. The sensors may include an accelerometer, a humidity sensor, a heart rate monitor, and an altimeter, a gyroscope, a thermocouple, and the like. In some embodiments, the performance module 60 may include a GPS tracker and/or function as a pedometer.

In some embodiments, performance module 60 may include signal processing capabilities to amplify collected sensor signals and filter noises and other artifacts, among other functionalities.

The performance module 60 also may include a timer, such as a real time clock or the like. The timer may be utilized for data tracking and analysis associated with exercise activities as a function of time. Thus, the timer can be utilized in calculations having a time component, including but not limited to speed and acceleration. Those of ordinary skill will recognize that any suitable time tracking device or component may be used as timer. It is further contemplated that timer may be utilized in other suitable manners.

In some embodiments, the performance module 60 may track and report exercise, training and physical movement assessments involving the elastic body apparatus 10.

It is further contemplated that the elastic body 34 may be operatively associated with a force sensor (module) to determine the level of force exerted against the elastic body 34. In some embodiments, strain gauges measure the force being exerted by the user. In another embodiment, since the elastic body 34 wraps around the spool 59, force may be determined through conversion of the sensed torque by multiplying the force by the radius of the spool 59.

The performance module 60 may, via the wireless communication module, may send indications of a performance profile associated with the utilization of the elastic body 34, specifically the force exerted against the elastic body, the repetitions thereof, and other time-related parameters, along with other exercise data collected by the above-mentioned plurality of sensors. The indications of one user's performance profile may be represented on another user's interface device 18 and/or user interface of their networked terminal 56 (e.g., smart device). The present invention may also help with remote rehabilitation and live training, and therapy between doctor and patients. This wireless communication functionality may also connect a user via their smart device for a virtual reality or augmented reality experience with your workout partner.

In certain embodiments, the network may refer to any interconnecting system capable of transmitting audio, video, signals, data, messages, or any combination of the preceding. The network may include all or a portion of a public switched telephone network (PSTN), a public or private data network, a local area network (LAN), a metropolitan area network (MAN), a wide area network (WAN), a local, regional, or global communication or computer network such as the Internet, a wireline or wireless network, an enterprise intranet, or any other suitable communication link, including combinations thereof.

The server and the computer of the present invention may each include computing systems. This disclosure contemplates any suitable number of computing systems. This disclosure contemplates the computing system taking any suitable physical form. As example and not by way of limitation, the computing system may be a virtual machine (VM), an embedded computing system, a system-on-chip (SOC), a single-board computing system (SBC) (e.g., a computer-on-module (COM) or system-on-module (SOM)), a desktop computing system, a laptop or notebook computing system, a smart phone, an interactive kiosk, a mainframe, a mesh of computing systems, a server, an application server, or a combination of two or more of these. Where appropriate, the computing systems may include one or more computing systems; be unitary or distributed; span multiple locations; span multiple machines; or reside in a cloud, which may include one or more cloud components in one or more networks. Where appropriate, one or more computing systems may perform without substantial spatial or temporal limitation one or more steps of one or more methods described or illustrated herein. As an example and not by way of limitation, one or more computing systems may perform in real time or in batch mode one or more steps of one or more methods described or illustrated herein. One or more computing systems may perform at different times or at different locations one or more steps of one or more methods described or illustrated herein, where appropriate.

In some embodiments, the computing systems may execute any suitable operating system such as IBM's zSeries/Operating System (z/OS), MS-DOS, PC-DOS, MAC-OS, WINDOWS, UNIX, OpenVMS, an operating system based on LINUX, or any other appropriate operating system, including future operating systems. In some embodiments, the computing systems may be a web server running web server applications such as Apache, Microsoft's Internet Information Server™, and the like.

In particular embodiments, the computing systems includes a processor, a memory, a user interface and a communication interface. In particular embodiments, the processor includes hardware for executing instructions, such as those making up a computer program. The memory includes main memory for storing instructions such as computer program(s) for the processor to execute, or data for processor to operate on. The memory may include mass storage for data and instructions such as the computer program. As an example and not by way of limitation, the memory may include an HDD, a floppy disk drive, flash memory, an optical disc, a magneto-optical disc, magnetic tape, a Universal Serial Bus (USB) drive, a solid-state drive (SSD), or a combination of two or more of these. The memory may include removable or non-removable (or fixed) media, where appropriate. The memory may be internal or external to computing system, where appropriate. In particular embodiments, the memory is non-volatile, solid-state memory.

The user interface includes hardware, software, or both providing one or more interfaces for communication between a person and the computer systems. As an example and not by way of limitation, an user interface device may include a keyboard, keypad, microphone, monitor, mouse, printer, scanner, speaker, still camera, stylus, tablet, touch-screen, trackball, video camera, another suitable user interface or a combination of two or more of these. A user interface may include one or more sensors. This disclosure contemplates any suitable user interface and any suitable user interfaces for them.

The communication interface includes hardware, software, or both providing one or more interfaces for communication (e.g., packet-based communication) between the computing systems over the network. As an example and not by way of limitation, the communication interface may include a network interface controller (NIC) or network adapter for communicating with an Ethernet or other wire-based network or a wireless NIC (WNIC) or wireless adapter for communicating with a wireless network, such as a WI-FI network. This disclosure contemplates any suitable network and any suitable communication interface. As an example and not by way of limitation, the computing systems may communicate with an ad hoc network, a personal area network (PAN), a local area network (LAN), a wide area network (WAN), a metropolitan area network (MAN), or one or more portions of the Internet or a combination of two or more of these. One or more portions of one or more of these networks may be wired or wireless. As an example, the computing systems may communicate with a wireless PAN (WPAN) (e.g., a BLUETOOTH WPAN), a WI-FI network, a WI-MAX network, a cellular telephone network (e.g., a Global System for Mobile Communications (GSM) network), or other suitable wireless network or a combination of two or more of these. The computing systems may include any suitable communication interface for any of these networks, where appropriate.

It should be understood, of course, that the foregoing relates to exemplary embodiments of the invention and that modifications may be made without departing from the spirit and scope of the invention as set forth in the following claims.

What is claimed is:

1. A system for selectively establishing a fixed length of an elastic body, the system comprising:

a retracting mechanism configured to establish the fixed length relative to a housing;

the housing retaining a proximal end of the elastic body, wherein the elastic body is movable between a retracted position and one of a plurality of successively extended positions further protruding from the housing, wherein the housing provides a locking mechanism for selectively engaging each of the extended positions, whereby the fixed length is established;

a user interface;

one or more processors;

a non-transitory computer-readable memory coupled to the one or more processors and the user interface and storing instructions thereon that, when executed by the one or more processors, causing the system to:

receive exercise data for the elastic body, including information indicative of a level of force exerted against the elastic body; and present one or more force determinations, based on the information indicative of a level of force, on the user interface; and one or more force sensors operatively associated with the elastic body, wherein the one or more force sensor collects the information indicative of a level of force, wherein the one or more force sensors includes a torque sensor, wherein the retracting mechanism comprises one or more ratchet portions configured to coil and recoil the elastic body about a spool to which the torque sensor is coupled.

2. The system of claim 1, wherein the one or more force sensors includes a strain gauge.

3. The system of claim 1, further comprising a communication module for exporting each force determination.

4. The system of claim 3, for each force determination, receive exercise data associated with the elastic body.

5. The system of claim 4, further comprising a timer operatively associated with the elastic band for collecting data of the exercise data as a function of time.

6. The system of claim 4, further comprising a bar grip perpendicularly extending from a center of the housing.

7. The system of claim 1, wherein the one or more ratchet portions operatively associate with a recoil spring and the spool to rotatably extend and retract the elastic body about the spool.

8. The system of claim 7, wherein one of the one or more ratchet portions has ratchet teeth to controllably engage a spring biasing the locking mechanism.

9. A method for communicating between a plurality of users of resistance bands, the method comprising:

providing the system of claim 5 to each user, wherein each force determination and exercise data is shared between the other users by way of each user interface, respectively.

10. The method of 9, further comprising representing the exercise data as a function of time on the user interface.

11. The method of claim 10, wherein the exercise data as a function of time includes a count of repetitions of each force determination.

* * * * *